US005961095A

United States Patent [19]

Schrott

[11] Patent Number: 5,961,095

[45] Date of Patent: Oct. 5, 1999

[54] ELECTRONICALLY CONTROLLED WATER FAUCET

[76] Inventor: Harald Schrott, Oeschlaenderweg 1, 88131 Lindau, Germany

[21] Appl. No.: 08/913,234

[22] PCT Filed: Mar. 8, 1996

[86] PCT No.: PCT/DE96/00442

§ 371 Date: Sep. 10, 1997

§ 102(e) Date: Sep. 10, 1997

[87] PCT Pub. No.: WO96/28618

PCT Pub. Date: Sep. 19, 1996

[30] Foreign Application Priority Data

Mar. 10, 1995 [DE] Germany ..... 195 08 644

[51] Int. Cl.[6] ..... F16K 31/02

[52] U.S. Cl. ..... 251/129.04; 251/129.05; 137/801; 4/623

[58] Field of Search ..... 251/129.04, 129.05; 137/801; 4/623, 678; 340/603

[56] References Cited

U.S. PATENT DOCUMENTS

| | | | |
|---|---|---|---|
| 3,740,487 | 6/1973 | Ter Veen | 379/102.06 |
| 4,839,039 | 6/1989 | Parsons et al. | 251/129.04 |
| 5,095,941 | 3/1992 | Betz | 251/129.04 |
| 5,145,575 | 9/1992 | Burrows | 340/603 |
| 5,173,178 | 12/1992 | Kawashima et al. | 251/129.04 |
| 5,184,642 | 2/1993 | Powell | 251/129.04 |
| 5,187,818 | 2/1993 | Barrett, Sr. et al. . | |

FOREIGN PATENT DOCUMENTS

| | | | |
|---|---|---|---|
| 0312781 | 4/1989 | European Pat. Off. . | |
| 0501262 | 9/1992 | European Pat. Off. . | |
| 0501263 | 9/1992 | European Pat. Off. . | |
| 0530856 | 3/1993 | European Pat. Off. . | |
| 1291960 | 4/1969 | Germany . | |
| 3404000 | 2/1985 | Germany . | |
| 3920581 | 1/1991 | Germany . | |
| 4106540 | 4/1992 | Germany . | |
| 9211577 | 11/1992 | Germany . | |
| 52-47183 | 4/1977 | Japan | 251/129.05 |
| 94/00645 | 1/1994 | WIPO . | |

OTHER PUBLICATIONS

IKZ–Haustechnik, 1991, H. 9, p. 73.

*Primary Examiner*—Denise L. Ferensic
*Assistant Examiner*—John Ball
*Attorney, Agent, or Firm*—Venable; George H. Spencer; Catherine M. Voorhees

[57] ABSTRACT

A water outlet fitting with a transmitter, a receiver and an electronic circuit for the contactless operation of an integrated non-return valve, in which the circuit is designed for operation in a plurality of selectable functions. On the fitting there is a manually operable switch, especially a push-button which, when operated, can issue setting commands in the form of switching pulse groups in order to select and activate a given function.

3 Claims, 1 Drawing Sheet

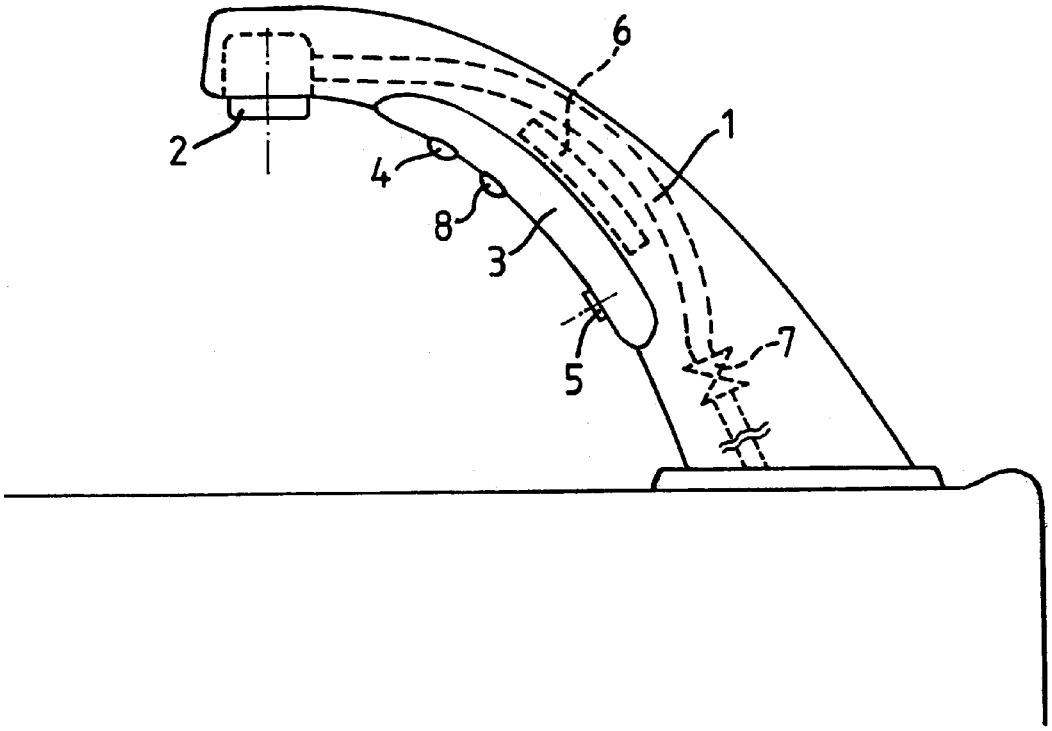
6
1
2
4
8
3
5
7

ELECTRONICALLY CONTROLLED WATER FAUCET

BACKGROUND OF THE INVENTION

The invention relates to a water outlet faucet having a transmitter, a receiver and an electronic circuit arrangement for non-contact actuation of a built-in shut-off valve, "Non-contact" water outlet faucets of this type are to be understood both as wash basin faucets and other washing devices and the like required in the sanitary sector. They generally operate using infrared beams, which are reflected by the hands or other body parts of the user and are picked up by the receiver.

There are already intelligent water outlet faucets which contain a highly developed, comprehensive electronic circuit arrangement (microprocessor), which is fed by a built-in battery. Such a circuit arrangement can be operated in various modes of operation, so-called functions, which differ from the basic mode of operation in which cold water flows as long as there are hands under the outlet. The selection of the mode of operation takes place with the aid of a special setting device (remote control) by transmitting infrared setting signals which are picked up by a decoding device contained in the circuit arrangement via the receiver, which is otherwise used operationally, for example as a photoresistor.

However, the device is generally not ready to pick up, its operation is to some extent complicated and it makes the purchase price of the automatic faucet more expensive.

SUMMARY OF THE INVENTION

Another faucet of this type is described in the utility model DE-U-92 11 577. A distinction is made there between the operating modes or functions OFF, COLD, AUTOMATIC and HOT. A selection switch is provided for adjusting a specific function, the rotating element of which engages in the various stop locations. A multiple key switch is provided as alternative. However, the installation of such a relatively complicated switch on a water faucet is problematic and involved due to the space requirement as well as the necessary protection against moisture.

The invention is therefore based on the object of carrying out the selection of the function, or the changing over of the electronic circuit arrangement from one function to another, in a more expedient and simpler fashion.

Starting from a water outlet faucet of the type mentioned at the outset, this object is achieved according to the invention in that an externally accessible, hand-operated electric OFF/ON switch is arranged on the faucet which generates respective actuation setting commands in the form of switching pulse groups that differ in terms of number and/or length and/or the sequence of the individual pulses. A decoding device of the water outlet faucet is adjusted to the switching pulse groups. A switch is firmly fitted to the faucet, the switch being readily operated by hand and serving as command transmitter for the appropriately configured electronic circuit arrangement or its decoding device. Using the switch, OFF/ON signals and hence pulses of any desired duration-can be entered, which are picked up by the decoding device and converted in a desired manner. The command is, for example, a pulse group which differs from another pulse group in particular by the number and/or length and/or sequence of its individual pulses. For example, the commands for the selection of the function can be identified by a number of short pulses and the setting commands of the subfunction can be identified by longer pulses.

In the preferred and simplest case, the switch is a pushbutton, which is seated on the outer surface of the faucet and is readily accessible. However, it can also be built into the faucet and covered by a watertight skin or can be actuated by means of a pin or any other simple tool. It is further proposed to design the switch as a so-called sensor switch on a capacitive basis. Finally, if a plurality of photoresistors are provided as the receiver for normal operation or else by means of an additional "input receiver", this receiver can be used as a switch by being completely covered by the fingertip. This capability for influencing the circuit arrangement presupposes, however, that by means of a comparison measurement using another receiver, it has been established that a specific room illumination is present, and the darkening of the "input receiver" cannot be attributed to total darkening of the operating room.

It is known to equip automatic water outlet faucets of the type described with an optical indicator device, for example with a light-emitting diode. This indicates, for example, progressive battery consumption. If now, via the input switch, as described, the electronic circuit arrangement is changed over to another function, it can be advantageous if the operating person can also monitor the correct selection. To this end it is proposed that an optical indicator device be provided, which acknowledges the setting command entered by means of the switch. In the simplest case, the command pulses are accompanied visually. However, it is also possible for a light signal typical of the function to be output after the input of commands from the faucet has been completed. Finally, it is possible to facilitate the actuation of the switch by means of regular flashing signals. For instance, it could be defined that, in order to input a specific command, the switch remains pressed until the light-emitting diode has flashed on 5 times.

BRIEF DESCRIPTION OF THE DRAWING

An exemplary embodiment of the invention is explained below using the single drawing.

DETAILED DESCRIPTION OF THE INVENTION

A water outlet faucet 1 having a flow straightener 2 on the outlet opening is illustrated. An electronic circuit arrangement 6 and the necessary battery are accommodated in an attachment housing 3. It also carries the transmitting/receiving unit 4, by means of which the built-in shut-off valve 7 is actuated, when the hands are held under the outlet or removed once more. Furthermore, there is arranged on the attachment housing 3 a pushbutton 5, whose actuation allows at least some of the following functions and subfunctions, indicated by way of example, to be selected:

Permanently ON: This is the normal function. The water runs when the hands are held under the water outlet.

Permanently OFF: The faucet is out of operation. No current is consumed. This function is necessary, for example, in the case of hotels which are occupied only seasonally TEMPERATURE: In this function, the outflow temperature can be set by means of further commands, if a mixing valve is provided.

FLOW: In this case, the water stream can likewise be regulated by means of subsequent commands.

QUANTITY DISPENSED: This function provides that, following the first-time water requirement, the faucet remains open for a specific period of time and then shuts off automatically. In this way, depending on the flow, a specific dispensed quantity, for example 5 liters, is discharged. This can be expedient in the case of commercial operations in which vessels of specific size have to be repeatedly filled. The amount dispensed can be changed in a subfunction.

SERVICE WATER/DRINKING WATER If a filter device or water treatment device is provided, water can optionally be taken from one of the two lines by means of an additional changeover valve.

SENSITIVITY OF THE SENSOR MECHANISM: In the case of this function, the faucet can be adapted optimally by means of further commands to specific installation conditions.

CURRENT-SAVING FUNCTION: The sensor pulses, which are output, for example, at intervals of 0.8 seconds, constitute a current consumption which is of importance. By prolonging the pulse interval in this function, an increase in the service life of the battery can therefore be achieved.

In the case of this example described, the decoding device of the circuit arrangement is designed in such a way that the individual functions are selected by means of the number of short switching pulses. A setting operation to be undertaken within this function, for example of the interval of the sensor pulses, is performed following a pause by means of longer-lasting pressing of the pushbutton 5, as a result of which the setting variable runs through a cycle from the smallest to the largest value. The setting operation is terminated by releasing the pushbutton. Each subsequent input operation automatically cancels the preceding function. An optical indicator device 8 is provided on the attachment housing 3. The optical indicator device 8 acknowledges the setting command entered by means of switch 5.

I claim:

1. A water outlet faucet having a transmitter a receiver a shut-off valve that can be electrically actuated and an electronic circuit arrangement for non-contact actuation of a built-in shut-off valve, said circuit arrangement having a plurality of functions and a decoding device, which accepts encoded setting commands for adjusting one of the possible functions and for rendering them effective, said faucet further comprising an externally accessible, hand-operated electric OFF/ON switch which generates respective actuation setting commands in the form of switching pulse groups that differ in at least one of number, length and the sequence of the individual pulses and wherein the decoding device is adjusted to these switching pulse groups.

2. A water outlet faucet according to claim 1, wherein the switch is a pushbutton.

3. A water outlet faucet according to claim 1, further comprising an optical indicator device which acknowledges the setting command entered by means of the switch.

* * * * *